United States Patent [19]

von der Eltz et al.

[11] 4,414,000

[45] Nov. 8, 1983

[54] PROCESS FOR THE CONTINUOUS OR SEMICONTINUOUS DYEING OF VOLUMINOUS CELLULOSE FABRICS WITH AZO DEVELOPING DYESTUFFS USING ACRYLAMIDE POLYMERS

[75] Inventors: Hans-Ulrich von der Eltz, Frankfurt am Main; Peter Heinisch, Kelkheim; Hans J. Ballmann, Frankfurt am Main, all of Fed. Rep. of Germany

[73] Assignee: Hoechst AG, Frankfurt am Main, Fed. Rep. of Germany

[21] Appl. No.: 388,932

[22] Filed: Jun. 16, 1982

Related U.S. Application Data

[63] Continuation of Ser. No. 288,015, Jul. 29, 1981.

[30] Foreign Application Priority Data

Jul. 30, 1980 [DE] Fed. Rep. of Germany ..... 3028845

[51] Int. Cl.[3] ..... D06P 1/12; D06P 3/68

[52] U.S. Cl. ..... 8/555; 8/557; 8/666; 8/918

[58] Field of Search ..... 8/555, 666

[56] References Cited

U.S. PATENT DOCUMENTS

| | | | |
|---|---|---|---|
| 3,713,767 | 1/1973 | Lowenfeld et al. | 8/666 |
| 3,957,427 | 5/1976 | Chambers | 8/555 |
| 4,224,027 | 9/1980 | Hertel et al. | 8/666 |
| 4,304,567 | 12/1981 | Ballmann et al. | 8/555 |
| 4,323,363 | 4/1982 | Brachten et al. | 8/532 |

FOREIGN PATENT DOCUMENTS

| | | |
|---|---|---|
| 2808909 | 8/1979 | Fed. Rep. of Germany . |
| 1523408 | 8/1978 | United Kingdom . |

*Primary Examiner*—A. Lionel Clingman

*Attorney, Agent, or Firm*—Curtis, Morris & Safford

[57] ABSTRACT

Continuous dyeing of voluminous cellulose fabrics, according to a two-bath procedure and without intermediate drying, with azo dyes produced on the fiber by coupling of their formation components is effected by incorporation in a developing liquor with which the previously impregnated fabric is slop-padded, wet-in-wet, of a combination comprising homo- or copolymers of acrylic acid amide and a wetting agent into said developing liquor; the liquor uptake by the moist fiber material is increased and the penetration rate of this liquor during the coupling is incited in such a manner that textile articles which exhibit even, well penetrated dyeings are obtained.

Dyeing of for example cord, velvet, terry or pile fabrics with azo developing dyes has become feasible only in accordance with this invention. The process may be carried out also in semicontinuous operation.

8 Claims, No Drawings

PROCESS FOR THE CONTINUOUS OR SEMICONTINUOUS DYEING OF VOLUMINOUS CELLULOSE FABRICS WITH AZO DEVELOPING DYESTUFFS USING ACRYLAMIDE POLYMERS

This is a continuation of application Ser. No. 288,015, filed July 29, 1981.

The present invention relates to the even dyeing of a voluminous woven fabric, for example cord, velvet, terry or pile cloth, consisting of or containing preponderantly cellulose fibers, especially cotton, with at least one water-insoluble azo dyestuff produced on the fiber according to a continuous or semicontinuous method, in which the impregnation is performed by pre-padding the fabric web with a coupling component under alkaline conditions, and subsequently the development of the dyestuff is effected, wet-in-wet, by slop-padding the textile goods with a diazo component in the presence of an acid and/or an acid-forming substance.

In the dyeing of cotton fabrics with azo developing dyes on a padder, the coupling component and the diazo component are generally applied from separate baths; the goods being subjected to an intermediate drying between the two padding operations. This process is known for long years and carried out all over the world.

Many attempts have already been made in this connection to omit the intermediate drying which is expensive with respect to demand for time and consumption of energy and to practice the dyestuff development on the fiber by slop-padding the diazonium compound wet-in-wet onto the textiles still moist from the impregnation with the coupling component. However, this project could not be realized apart from exceptional cases; but nevertheless, application of this operational principle to voluminous fabrics has hitherto failed. The two main reasons which have caused this failure and that could not be removed until now are the following:

On the one hand, permeation of the goods, still wet from the preceding step, by the solution of the diazo component in the second padding operation is not sufficiently rapid; that is, within the dipping time counting. On the other hand, the amount of developing liquor containing the diazonium compound necessary for dyestuff formation and alkali-binding agent, which is present in the goods after the squeezing subsequent to the second padding operation is too small in order to ensure a thorough permeation of the fabric and thus complete coupling of all the available coupling component to yield the dyestuff.

However, as to an increase of the concentration of these two substances a limitation is set once because of the restricted solubility of the diazonium compound in the aqueous padding bath, and especially by reason of the fact that the concentration of alkali-binding agent (acetic acid) cannot be raised freely, since otherwise, directly from the first, on contact of the alkaline impregnation with the developing liquor due to the high acid concentration the pH is shifted locally to such a range which adversely affects the intended azo coupling. The result is uneven dyeings which have not penetrated through the fibers.

It was therefore the object of the present invention to overcome the cited disadvantages on two-bath dyeing of voluminous textile materials with the components for producing water insoluble azo dyestuffs on the fiber. With respect to the feasibility of a wet-in-wet dyeing, it was required above all to achieve a sufficient additional liquor uptake by the moist impregnated goods on second padding, in order to ensure a satisfactory liquor exchange and to maintain the concentration conditions in the slop-padding liquor (developing liquor) within usual limits.

In accordance with the invention, these objects are achieved by incorporating into the acidic developing liquor containing the diazo component capable of being coupled an auxiliaries' combination of a polymeric component selected from the group consisting of homopolymers and copolymers of acrylic acid amide and mixtures of the foregoing, said polymeric component being incorporated in an amount of from 30 to 60 g/l in the form of a 2 to 8, preferable 4 to 5%, (by weight) aqueous formulation, and of from 2 to 20 g/l of an anionic or nonionic wetting agent.

Suitable homopolymers or copolymers of acrylic acid amide are, for example:

a. linear or branched homopolymers of acrylic acid amide;
b. copolymers of acrylic acid amide and semiesters of maleic acid with polyglycol ethers of natural or synthetic fatty alcohols of from 12 to 18 carbon atoms with 5 to 10 mols of ethylene oxide per mol of fatty alcohol, in the weight ratio of from 1:0.05 to 1:0.5, calculated on the acrylic acid amide;
c. copolymers of acrylic acid amide and acrylamido-lower alkane-sulfonic acid in the weight ratio of from 1:0.05 to 1:0.5, calculated on the acrylic acid amide;
d. copolymers of acrylic acid amide and N-vinyl-N-methylacetamide in the weight ratio of from 1:0.05 to 1:0.5, calculated on the acrylic acid amide;
e. mixtures of the polymers specified under (a) to (d) above among one another and optionally in combination with $\epsilon$-caprolactam in the weight ratio of from 1:0.5 to 1:1, calculated on the polymers.

The homopolymers of acrylic acid amide or the copolymers thereof with the other monomers cited sub (a) through (e) have a molecular weight of from $1.0\times10^6$ to $2.5\times10^6$, preferably $1.5\times10^6$ to $2.0\times10^6$.

Surprisingly, the specific properties of the above acrylic acid amide polymers bring about an increased liquor pick-up at the same roll pressure (in bar/cm$^2$). This effect is about proportional to the applied amount of the products, i.e. the higher the concentration applied, the greater the increase of liquor pick-up within a technically justifiable range (in accordance with the recommended concentration of the polymers added).

The assistance of homopolymers and copolymers of acrylic acid amide and a wetting agent according to the invention favorably affects dyestuff formation in that the liquor uptake by the goods during the slop-padding operation, wet-in-wet, with the developing bath is increased and that the penetration through the voluminous substrate is incited in such a manner that even and completely dyed-through textiles are obtained.

It could not be expected that by means of the novel mode of processing a liquor uptake of 70 to 90% (of the weight of the dry goods), depending on setting of the rolls and efficiency of the padder used, is achieved on the cited textiles in addition to the liquor already present from the impregnation padding, that is, as the final result a total liquor uptake rate of 140 to 170 weight % when padding twice. Only this quantity of liquor which is additionally available now permits the diazo component to be dissolved in the necessary amount, and the concentration of alkali-binding agent is thus kept pending at a normal level. Moreover, the wetting agent ensures rapid distribution of the second padding liquor in the goods, thus resulting in uniform dyestuff formation on the fiber.

When, contrary to the foregoing teaching, the auxiliaries in accordance with the invention are omitted in the second padding with the diazo component, an additional liquor uptake is not obtained, or a maximum of 20% only when setting the rolls of the padder to lowest pressure. In this small amount of liquor, however, a 4- to 5-fold increased quantity of diazonium compound and alkali-binding agent as compared to normal conditions (with intermediate drying) would then have to be dissolved.

Suitable textile materials for the process of the invention are voluminous woven fabrics, such as cord, velvet, terry and pile fabrics, which consist of or contain preponderantly cellulose fibers, especially cotton, for which the uniformity of dyeing is particularly important. As fabrics of such kind, even unbleached loom-state goods (especially advantageous with very full or covered shades) may be used.

For the dyeing of textiles according to the invention those chemical compounds conventional for producing developing dyestuffs and listed in Colour Index, 3rd ed., 1971 as "Azoic Coupling Component" and "Azoic Diazo Component" are considered useful.

Of the polymeric products derived from acrylic acid amide applied in accordance with the invention, some are already known (German Offenlegungsschrift No. 2,542,051 CASSELLA AKTIENGESELLSCHAFT); however, they are used for a completely different purpose, namely to suppress the "frosting effect" in the dyeing of polyester fibers with disperse dyestuffs.

The novel process is carried out as follows:

The first padding for impregnation purposes is carried out as customary on a padder using an alkaline solution of a coupling component. Thus liquor uptake value of generally from 70 to 80 weight % is obtained. After an air passage (continuously) or an intermediate short-time dwelling of the goods (semicontinuously), the impregnation so obtained is slop-padded, wet-in-wet, in the presence of an alkali-binding agent (acid or acid-forming substances) with the developing liquor containing a diazo component capable of being coupled, the auxiliaries' combination according to the invention comprising acrylic acid amide polymer and wetting agent being added to this padding liquor in the amounts as indicated.

The following Examples illustrate the invention without limiting its scope in any way, especially with respect to the wetting agents used. Percentages referred to in the Examples are by weight; in the case of wet treatment of textiles these percentages of liquor uptake are relative to the weight of the dry goods.

EXAMPLE 1

A cotton cord fabric is pre-padded on a padder so as to yield a liquor uptake of 70%, with an aqueous solution containing the following substances:

20 g/l of Azoic Coupling Component 2, C.I. No. 37505,
20 $cm^3$/l of a 32.5% sodium hydroxide solution,
5 $cm^3$/l of a protective colloid on the basis of a fatty acid/protein condensation product, and
2 g/l of a wetting agent on the basis of an alkylsulfonate.

After an air passage of the goods for 60 seconds, the impregnation so produced is slop-padded, wet-in-wet, on a padder using an aqueous developing liquor containing 40 g/l of a 45% liquid formulation of the diazonium compound of Azoic Diazo Component 9, C.I. No. 37040,
2.4 g/l of amidosulfonic acid,
30 g/l of sodium acetate, cryst.,
5 $cm^3$/l of a 60% strength acetic acid,
30 g/l of a 4.3% aqueous formulation of a linear homopolymer of acrylic acid amide (molecular weight $1.4\times10^6$) and
5 g/l of a wetting agent consisting of a sodium alkylsulfonate and 10% of the addition product of 8 mols of ethylene oxide onto 1 mol of isotridecanol.

In this manner results a further liquor uptake of 70% on the textile goods. After a second air passage of the textile article so treated for 60 seconds and a passage through hot water of 80° C. for dyestuff coupling, an even and well penetrated dyeing in a vivid red shade is obtained on the cotton cord. After-treatment of the dyeing is as usual in the case of developing dyes.

EXAMPLE 2

Cotton cord is to be dyed continuously. The textiles are first padded on a padder so as to yield 80% of liquor uptake, using an aqueous solution of
18 g/l of Azoic Component 20, C.I. No. 37530,
18 g/l of a 32.5% sodium hydroxide solution,
5 g/l of a protective colloid as in Example 1, and
2 g/l of a wetting agent on the basis of an alkylsulfonate.

After padding and an immediately subsequent air passage, this impregnation is slop-padded, wet-in-wet on the padder with a developing liquor containing per liter of water
56 g of a stabilized diazonium compound of Azoic Diazo Component 3, C.I. No. 37010 (commercial formulation), 2 g of a dispersing agent on the basis of oxethylated stearyl alcohol,
45 g of a 4% aqueous formulation of a copolymer of acrylic acid amide and 2-acrylamido-2-methyl-propane-1-sulfonic acid, in a weight ratio of 1:0.1, relative to acrylic acid amide (molecular weight of the copolymer: $1.9\times10^6$), and 5 g of the wetting agent of Example 1 (second padding). A further liquor uptake of 80% is achieved on the cord by this slop-padding operation, so that the total liquor uptake of the goods is 160%. An air passage of the fiber material for 40 seconds and a passage through hot water of 80° C. complete the dyestuff coupling.

Subsequently, the dyeing so produced is soaped in an aqueous liquor with addition of the following substances:

1st soaping bath, 60° C.:
1 g/l of oleylmethyltaurine and
5 g/l of calcined soda.

2nd and 3rd soaping bath, boiling temperature:
0.5 g/l of oleylmethyltaurine and
2 g/l of calcined soda.

The processing of continuous dyeing is terminated by rinsing and drying. A vividly red, well penetrated dyeing is obtained in this manner on the cotton cord.

When, however, in the above dyeing process in the padding liquor containing the diazo component the auxiliaries' combination comprising copolymer and wetting agent is omitted, then a further liquor uptake of 20% at most only is attained even when setting the rolls of the padder to weakest pressure (0.5 bar/$cm^2$), and an uneven dyeing which has not penetrated through the fiber material is the result on the cotton cord.

EXAMPLE 3

A grey, unbleached cotton cord is to be dyed continuously with developing dyes. First, the textiles are prepadded on a padder so as to yield 70% of liquor uptake, using an aqueous liquor containing the following substances:

20 g/l of Azoic Coupling Component 24, C.I. No. 37540 (dissolved according to the directions for dissolution in cold state),
20 $cm^3$/l of a 32.5% sodium hydroxide solution,
5 $cm^3$/l of a protective colloid as in Example 1,
3 $cm^3$/l of a wetting agent on the basis of an alkylsulfonate, and
3 $cm^3$/l of a complexing agent on the basis of an ethylenediamine acetate. After padding, an air passage of the goods for 2 minutes follows, and subsequently this impregnation is slop-padded, wet-in-wet, on a padder using an aqueous developing liquor containing
56 g/l of a stabilized diazonium compound of Azoic Diazo Component 49, C.I. No. 37050 (commercial formulation)
60 g/l of a 4% aqueous formulation of a copolymer of acrylic acid amide and the maleic acid semiester of a polyglycol ether from the addition product of 8 mols of ethylene oxide onto 1 mol of isotridecanol, in a weight ratio of 1:0.075, relative to acrylic acid amide (molecular weight of the copolymer: $1.47\times10^6$), and
5 g/l of a wetting agent on the basis of an alkylsulfonate and an oxethylated isotridecanol.

After padding, an air passage of the fiber material so treated for 30 seconds and a passage through hot water of 80° C. complete the dyestuff formation by coupling. Subsequently, the goods so dyed are soaped and dried as indicated in Example 2. Thus, a perfectly penetrated dyeing in a dull orange shade is obtained on the cord.

The additional liquor uptake on slop-padding of the textiles dyed as described is 90%, so that a total liquor uptake of 160% is attained in accordance with the invention. When, however, slop-padding the goods is carried out, wet-in-wet, without adding the auxiliaries' combination comprising copolymer and wetting agent, an additional liquor uptake is not obtained, and the dyeing on the cord is uneven and has not penetrated through the fiber material.

EXAMPLE 4

A terry fabric is padded on a padder such to yield a liquor uptake of 80%, using an aqueous solution of 20 g/l of Azoic Coupling Component 8, C.I. No. 37525 (dissolved according to the directions for dissolution in cold state),
20 $cm^3$/l of a 32.5% sodium hydroxide solution,
100 $cm^3$/l of ethanol denat.
2 $cm^3$/l of a wetting agent,
5 $cm^3$/l of the protective colloid of Example 1, and
2 $cm^3$/l of a complexing agent.

The goods so impregnated are wound up and allowed to dwell for 1 hour. Subsequently, they are slop-padded, wet-in-wet, using an aqueous developing liquor containing 62 g/l of a stabilized diazonium compound of Azoic Diazo Component 2, C.I. No. 37005,
30 g/l of a 4.5% aqueous formulation of a linear homopolymer of acrylic acid amide (molecular weight $1.4\times10^6$)
5 g/l of a wetting agent comprising of 80% of a sodium alkylsulfonate and 20% of the addition product of 8 mols of ethylene oxide onto 1 mol of isotridecanol,
16 $cm^3$/l of a 60% strength acetic acid, and
2 $cm^3$/l of a dispersing agent on the basis of oxethylated stearyl alcohol.

An additional liquor uptake of 80% is the result on the textiles treated in this manner. After an air passage of the so treated article for 1 minute and a passage through hot water of 80° C. for dyestuff coupling, as well as the usual soaping (see Example 2) and drying, a vivid orange dyeing which has well penetrated through the goods is obtained.

What is claimed is:

1. In a process for the even dyeing of a voluminous woven fabric consisting of or containing preponderantly cellulose fibers, with at least one water-insoluble azo dyestuff produced on the fiber according to a continuous or semicontinuous method, in which the impregnation is performed by pre-padding the fabric web with a coupling component under alkaline conditions, and subsequently the development of the dyestuff is effected, wet-in-wet, by slop-padding the textile goods with a diazo component in the presence of an acid and/or an acid-forming substance, the improvement which compises incorporating into the acidic developing liquor containing the diazo component capable of being coupled combination of a polymeric component selected from the group consisting of homopolymers and copolymers of acrylic acid amide and mixtures of the foregoing, said polymeric component being incorporated in an amount of from 30 to 60 g/l in the form of a 2 to 8% (by weight) aqueous formulation, and of from 2 to 20 g/l of an anionic or nonionic wetting agent.

2. A process as claimed in claim 1, wherein said polymeric component is selected from the group consisting of linear homopolymers and branched homopolymers of acrylic acid amide.

3. A process as claimed in claim 1, wherein said polymeric component is selected from the group consisting of copolymers of acrylic acid amide and semiesters produced from maleic acid with polyglycol ethers of natural or synthetic fatty alcohols of from 12 to 18 carbon atoms and from 5 to 10 mols of ethylene oxide per mol of fatty alcohol, in a weight ratio of from 1:0.05 to 1:0.5, calculated on the acrylic acid amide.

4. A process as claimed in claim 1, wherein the polymeric component is selected from the group consisting of copolymers of acrylic acid amide and acrylamido-lower alkane-sulfonic acid in a weight ratio of from 1:0.05 to 1:0.5, calculated on the acrylic acid amide.

5. A process as claimed in claim 1, wherein said polymeric component is selected from the group consisting of copolymers of acrylic acid amide and N-vinyl-N-methylacetamide in a weight ratio of from 1:0.05 to 1:0.5, calculated on the acrylic acid amide.

6. A process as claimed in claim 1, wherein the polymeric component is a mixture of said homopolymers, a mixture of said copolymers or a mixture of one or more of said homopolymers and one or more of said copolymers.

7. A process as claimed in claim 1, wherein to said polymeric component $\epsilon$-caprolactam is added in a weight ratio of from 1:0.5 to 1:1, calculated on the weight of the polymeric component.

8. A process as claimed in claim 1, wherein the polymeric component has a molecular weight of from $1.0\times10^6$ to $2.5\times10^6$.

* * * * *